US005509461A

United States Patent [19]

Williams

[11] Patent Number: 5,509,461

[45] Date of Patent: Apr. 23, 1996

[54] GAS-GAS HEATER PROTECTION SYSTEM AND METHOD

[75] Inventor: Paul J. Williams, Franklin Township, Ohio

[73] Assignee: The Babcock & Wilcox Company, New Orleans, La.

[21] Appl. No.: 161,107

[22] Filed: Dec. 2, 1993

[51] Int. Cl.[6] ..... F23L 15/02

[52] U.S. Cl. ..... 165/8; 165/4; 110/345; 110/344; 110/215

[58] Field of Search ..... 165/5, 7, 39; 110/215, 110/345, 344; 422/168, 169, 171, 172

[56] References Cited

U.S. PATENT DOCUMENTS

| | | | |
|---|---|---|---|
| 3,997,294 | 12/1976 | Kritzler | 165/7 |
| 4,078,503 | 3/1978 | von Dreusche, Jr. | 110/345 X |
| 4,289,502 | 9/1981 | Meunger et al. | 48/62 R |
| 4,503,902 | 3/1985 | Zolik | 165/39 X |
| 4,909,160 | 3/1990 | Frick et al. | 110/215 |
| 5,000,924 | 3/1991 | Cygnarowicz et al. | 165/39 X |
| 5,048,430 | 9/1991 | Kawai | 110/345 X |
| 5,097,889 | 3/1992 | Ritter | 165/7 |
| 5,213,152 | 5/1993 | Cox | 165/7 |
| 5,282,429 | 2/1994 | Kato et al. | 110/215 |

*Primary Examiner*—John Rivell
*Assistant Examiner*—Christopher Atkinson
*Attorney, Agent, or Firm*—Eric Marich; Robert J. Edwards

[57] ABSTRACT

A system for protecting the material of a gas-gas heater which receives a raw flue gas for being provided to a desulfurization plant for cleaning of the flue gas comprises a path of raw flue gas having a gas temperature which is provided to the heater. A quench device communicates with the raw flue gas flow for providing a rapid cooling of the raw flue gas. A controller communicates with the flow of raw flue gas and the quench device. The controller has a variable, pre-set temperature value which is the temperature at which the material of the heater can be damaged. The controller monitors the temperature of the raw flue gas for detecting when the temperature of the raw flue gas is greater than the pre-set temperature value for activating the quench device in order to provide a rapid cooling of the raw flue gas until the gas temperature is less than the pre-set temperature value.

8 Claims, 1 Drawing Sheet

GAS-GAS HEATER PROTECTION SYSTEM AND METHOD

FIELD AND BACKGROUND OF THE INVENTION

The present invention relates, in general, to the treatment of flue gas, and in particular to a new and useful system and method for protecting gas-gas heaters used in conjunction with flue gas desulfurization systems.

It is a well-established practice to use gas-gas heaters for transferring heat from untreated flue gas to treated flue gas in wet flue gas desulfurization systems. The materials used in the gas-gas heaters comprise materials such as corrosion-resistant alloys or lined, low-alloy, carbon steel. Normally, a gas-gas heater is exposed to flue gas leaving the boiler train at a normal temperature range of 200°–350° F.

However, in case of an upset, such as an air heater drive failure, the temperature of the flue gas can increase to above the normal temperature range and in some cases exceed 700° F. When this occurs, the lining used in the gas-gas heater is unable to tolerate these higher temperatures and is severely damaged and sacrificed.

In an effort to prevent damage to the gas-gas heaters, higher alloys such as 317L stainless or Hastelloy® C-22 have been used to accommodate the higher temperatures. As expected, these higher alloys are expensive and provide a costly process when manufacturing and/or retrofitting gas-gas heaters using these alloys.

SUMMARY OF THE INVENTION

The present invention provides an emergency quench system in order to provide rapid cooling of flue gas prior to the flue gas entering the gas-gas heater. The rapid cooling provided by the quench system prevents damage to the lining of the gas-gas heaters without having to employ linings that are made of higher alloys. The quench system, according to the present invention, utilizes gas or liquid for cooling the temperature of the flue gas.

It is an object of the present invention to provide a system and method for rapidly cooling a flue gas prior to entering a gas-gas heater for preventing damage to the lining of the heater.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 2:
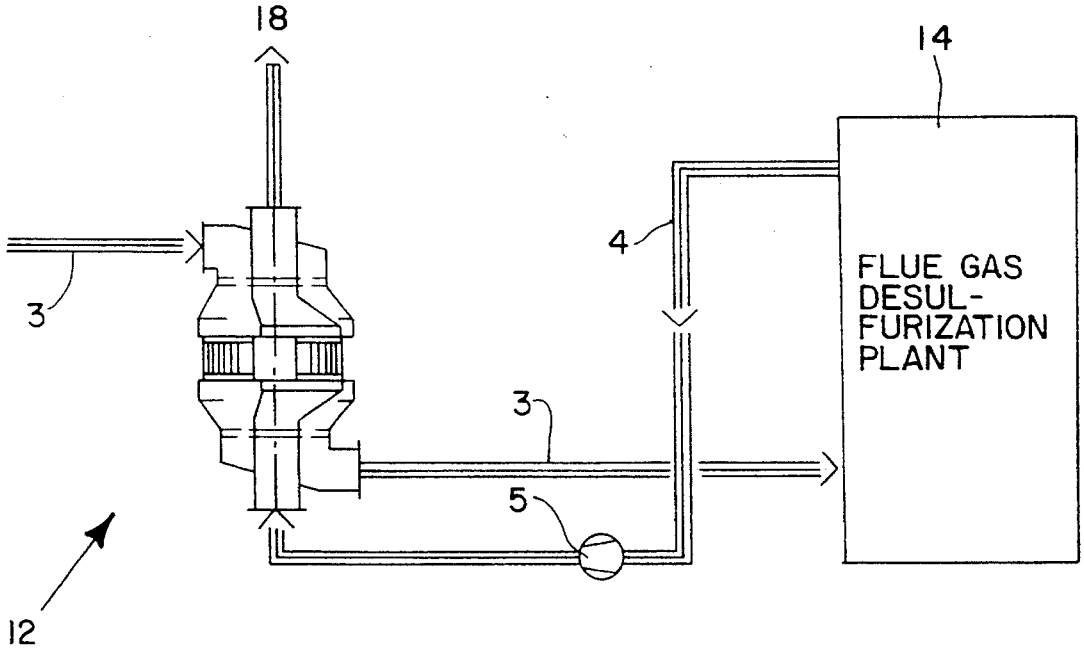
FIG. 2 is a schematic view of a known gas-gas heater used in conjunction with a flue gas desulfurization plant.

FIG. 2 illustrates a known system which comprises a gas-gas heater 12 which receives raw or raw gas 3 produced by a device such as a furnace or steam generator, etc. The hot, raw flue gas 3 is cooled by gas-gas heater 12, and in turn, is provided to a flue gas desulfurization plant 14 for cleaning the raw flue gas 3. After cleaning the flue gas in the plant 14, cooled clean flue gas 4 is provided back to the gas-gas heater 12 for heating, via booster fan 5 and is then provided to a stack 18 for exiting the system.

Figure 1:
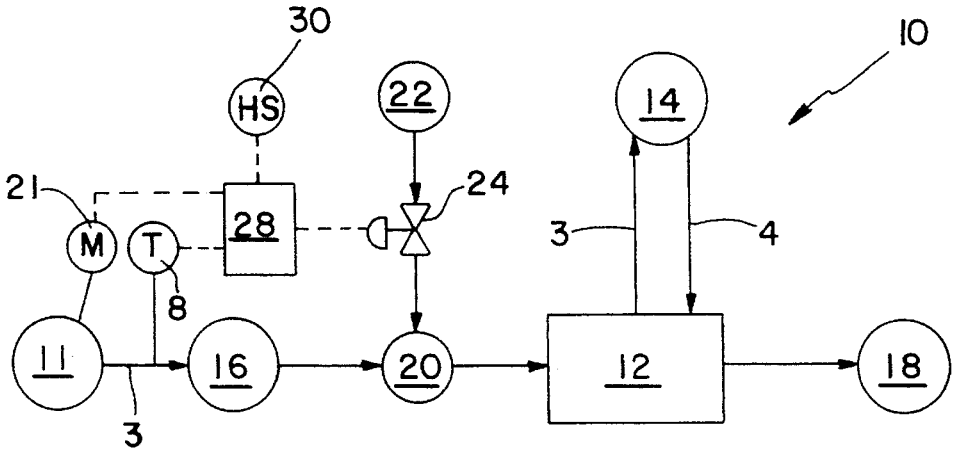
FIG. 1 is a schematic view illustrating a system using the present invention together with a schematic of a control system for same.

FIG. 1 illustrates a system, generally designated 10, which utilizes the present invention to provide a rapid cooling of raw flue gas 3 prior to entering the gas-gas heater 12. The system 10 illustrates one system which can be used in conjunction with the present invention, however, the present invention can be used with other types of systems which utilize a gas-gas heater 12 in conjunction with a flue gas desulfurization plant 14.

The system 10 comprises a combustion air heater 11 such as a rotary regenerative air heater 11, which produces a raw flue gas flow 3. A motion or motor amperage sensor 21 is used in conjunction with air heater 11 to monitor the motion (rotation) of air heater 11.

The raw flue gas 3 is provided to an induced draft fan 16 for boosting the flow of the raw flue gas 3.

The raw flue gas 3 is then provided through an emergency quench device 20 located upstream (with respect to the flow of flue gas 3) of the gas-gas heater 12. Quench device 20 communicates with a quench source 22 which can be either a liquid, such as water, or any type of cool, inert (non-combustible) gas, such as air to provide rapid cooling of the raw flue gas 3. An isolation device 24 is used to control the flow of the coolant from the quenching source 22 to the quench device 20. Isolation device 24 can be either a valve or a damper, depending of course upon the type of quench media used. A control means for controlling emergency quenching of the raw flue gas 3 comprises an actuator 28 which communicates with the isolation device 24. Actuator 28 also communicates with the motion sensor 21 of the combustion air heater 11.

A temperature switch or sensor 8 monitors the temperature of the raw flue gas 3 prior to its entry into the gas-gas heater 12. Temperature switch 8 communicates with the actuator 28 and has a variable (i.e., able to be changed by an operator to a desired value) pre-set temperature value which is a value indicating the temperature at which damage will be caused to the material of the gas-gas heater 12. If the temperature of the raw flue gas 3, prior to entry into the gas-gas heater 12, is greater than the pre-set temperature value, i.e. the temperature at which damage is caused to the gas-gas heater 12, then switch 8 is activated, causing actuator 28 to open isolation device 24 to permit the quenching medium 22 to flow into quench device 20 for providing a rapid cooling by mixing of the quenching medium 22 with the raw flue gas 3. Suitable nozzles and mixing devices (not shown) would be used to accomplish same. A hand override switch 30 communicates with the actuator 28 and is used by an operator to override actuator 28.

The present invention allows for gas-gas heaters 12 to be used with their present liners without being damaged when an upset condition arises. A damaged liner causes extensive corrosion damage to the gas-gas heater 12 unless repairs are made. These repairs require the unit to be shut down at a major cost to the operator. The present invention alleviates this problem.

While specific embodiments of the invention have been shown and described in detail to illustrate the application of the principles of the invention, it will be understood that the invention may be embodied otherwise without departing from such principles.

I claim:

1. A system for protecting a gas-gas heater made of a material, the heater for receiving hot, raw flue gas from an air heater and cooling same, the cooled raw flue gas being provided to a desulfurization plant for cleaning the flue gas and a cooled, clean flue gas being provided back to the gas-gas heater for heating after being cleaned in the desulfurization plant, the system comprising:

a hot, raw flue gas path from the air heater to the gas-gas heater, the hot, raw flue gas having a gas temperature;

quench means communicating with the hot, raw flue gas path at a location downstream of the air heater and upstream of the gas-gas heater for providing rapid cooling of the hot, raw flue gas entering the gas-gas heater; and control means communicating with the hot, raw flue gas path and the quench means, the control means having a variable, pre-set temperature value, the pre-set temperature value being a temperature value at which the material of the gas-gas heater can be damaged by the gas temperature of the hot, raw flue gas, the control means monitoring the hot, raw flue gas path at a location downstream of the air heater and upstream of the quench means for detecting when the gas temperature of the hot, raw flue gas leaving the air heater is greater than the pre-set temperature value and activating the quench means for rapidly cooling the hot, raw flue gas entering the gas-gas heater until the monitored gas temperature is less than the pre-set temperature value.

2. The system according to claim 1, wherein the quench means comprises a quench source.

3. The system according to claim 2, wherein the quench source comprises a liquid.

4. The system according to claim 2, wherein the quench source comprises a gas.

5. The system according to claim 1, wherein the control means comprises a temperature switch.

6. The system according to claim 5, wherein the control means further comprises an actuator communicating with the temperature switch and the quench means.

7. A method for protecting a gas-gas heater made of a material and which receives a hot, raw flue gas from an air heater and is used in conjunction with a desulfurization plant, the method comprising:

providing the hot, raw flue gas to the gas-gas heater;

monitoring a temperature of the hot, raw flue gas from the air heater; and rapidly cooling the hot, raw flue gas from the air heater with a liquid prior to entering the gas-gas heater when the monitored temperature of the hot, raw flue gas is greater than a temperature which can damage the material of the gas-gas heater, until the monitored temperature is less than the temperature which can damage the material of the gas-gas heater.

8. A method for protecting a gas-gas heater made of a material and which receives a hot, raw flue gas from an air heater and is used in conjunction with a desulfurization plant, the method comprising:

providing the hot, raw flue gas to the gas-gas heater;

monitoring a temperature of the hot, raw flue gas from the air heater; and rapidly cooling the hot, raw flue gas from the air heater with a gas prior to entering the gas-gas heater when the monitored temperature of the hot, raw flue gas from the air heater is greater than a temperature which can damage the material of the gas-gas heater, until the monitored temperature is less than the temperature which can damage the material of the gas-gas heater.

* * * * *